US006474745B2

(12) United States Patent
Seear

(10) Patent No.: US 6,474,745 B2
(45) Date of Patent: Nov. 5, 2002

(54) METHOD OF MINING

(75) Inventor: Peter Kenneth Seear, Brookfield (AU)

(73) Assignee: Cutting Edge Technology PTY Ltd., Queensland (AU)

( * ) Notice: Subject to any disclaimer, the term of this patent is extended or adjusted under 35 U.S.C. 154(b) by 0 days.

(21) Appl. No.: 09/891,094

(22) Filed: Jun. 25, 2001

(65) Prior Publication Data

US 2002/0005660 A1 Jan. 17, 2002

(30) Foreign Application Priority Data

Jun. 26, 2000 (AU) ..... PQ 8354

(51) Int. Cl.[7] ..... E21C 41/00

(52) U.S. Cl. ..... 299/10; 299/19

(58) Field of Search ..... 299/10, 18, 19, 299/95

(56) References Cited

U.S. PATENT DOCUMENTS 4,312,540 A * 1/1982 Thompson ..... 299/11

* cited by examiner

*Primary Examiner*—David Bagnell
*Assistant Examiner*—Brian Halford
(74) *Attorney, Agent, or Firm*—Ladas & Parry

(57) ABSTRACT

A method of mining using a pair of continuous mining machines 12 and an auger mining machine 16. The continuous mining machines form spaced longitudinal roads 10, 11, 13 and 14. Further longitudinal roads 17 are formed by the auger mining machine 16 with subsequent transverse roads 19 being sequentially by the continuous mining machines 12.

4 Claims, 5 Drawing Sheets

METHOD OF MINING

TECHNICAL FIELD

The present invention relates to mining and more particularly but not exclusively to the underground mining of coal.

BACKGROUND OF THE INVENTION

There are currently two primary methods of mining underground coal reserves:

Longwall Mining; and

Bord and Pillar Mining.

"Longwall" mining is essentially, two pairs of parallel generally coextensive roads are formed by continuous miners. A longwall shearer machine then works between the two pairs of roads to remove coal from the seam.

Bord and pillar mining is achieved by mining a series of lateral 'roads' with continuous miners which intersect longitudinal roads such that rectangular pillars are left unmined to act as a form of roof support.

Longwall mining requires large unfaulted tabular coal deposits in order to be effective while bord and pillar mining is unproductive and involves costly artificial roof support.

Both methods involve high capital expenditure relative to the amount coal produced.

OBJECT OF THE INVENTION

It is the object of the present invention to overcome or substantially ameliorate the above disadvantage.

SUMMARY OF THE INVENTION

There is disclosed herein a method of mining including the steps of:

(a) forming a pair of longitudinal generally parallel roads in a scam to be mined, the roads being transversely spaced;

(b) formed a transverse road between the pair of roads;

(c) forming a plurality of further longitudinal roads from the transverse road, the further longitudinal roads being located at spaced locations between said pair of longitudinal roads;

(d) forming a plurality of further transverse roads so that the further transverse roads and the further longitudinal roads intersect; and wherein (e) the further transverse roads are formed by a continuous miner that reciprocates between said pair of longitudinal roads and co-operates with a pair of extendable conveyors, conveyors being located on said further longitudinal roads to convey the mined material from the continuous miner, with the conveyors being located sequentially at longitudinally spaced locations along said pair of longitudinal roads as the further transverse roads are formed.

Preferably, the further longitudinal roads are formed by an auger mining machine.

Preferably there is associated with each pair of longitudinal roads a further longitudinal road, with said further transverse roads being arranged such that every second of said further transverse roads extends between a first one of said pair of longitudinal roads and its associated further longitudinal road, with the transverse roads other than said every second transverse road extending between a second one of said longitudinal roads and its associated further longitudinal road.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 2:
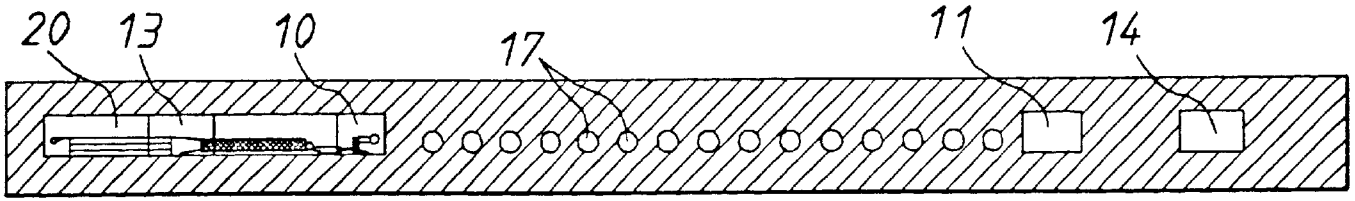
FIG. 2 is a schematic section side elevation of the mine of FIG. 1 sectioned along the line 2—2 of FIG. 1.

In the accompanying drawings, there is schematically depicted a method of mining, particularly coal mining.

In this preferred embodiment, a pair of parallel generally coextensive longitudinal roads 10 and 11 would be formed by one or more continuous mining machines 12. More preferably, the machine/s 12 would form a second pair of parallel generally coextensive roads 13 and 14, that is, roads parallel and coextensive with respect to the roads 10 and 11. The machine/s 12 would then form at least one transverse road 15. Following the machine 12 forming the road 15, an auger mining machine 16 would be operated to form longitudinal roads (tunnels) 17. During formation of the roads 10, 11 and 13–15, the mined material (coal) would be removed by means of conveyors, such as the longitudinally extendable conveyor 18 illustrated and associated with the machine 12 that is illustrated or alternatively shuttle cars.

Figure 1:
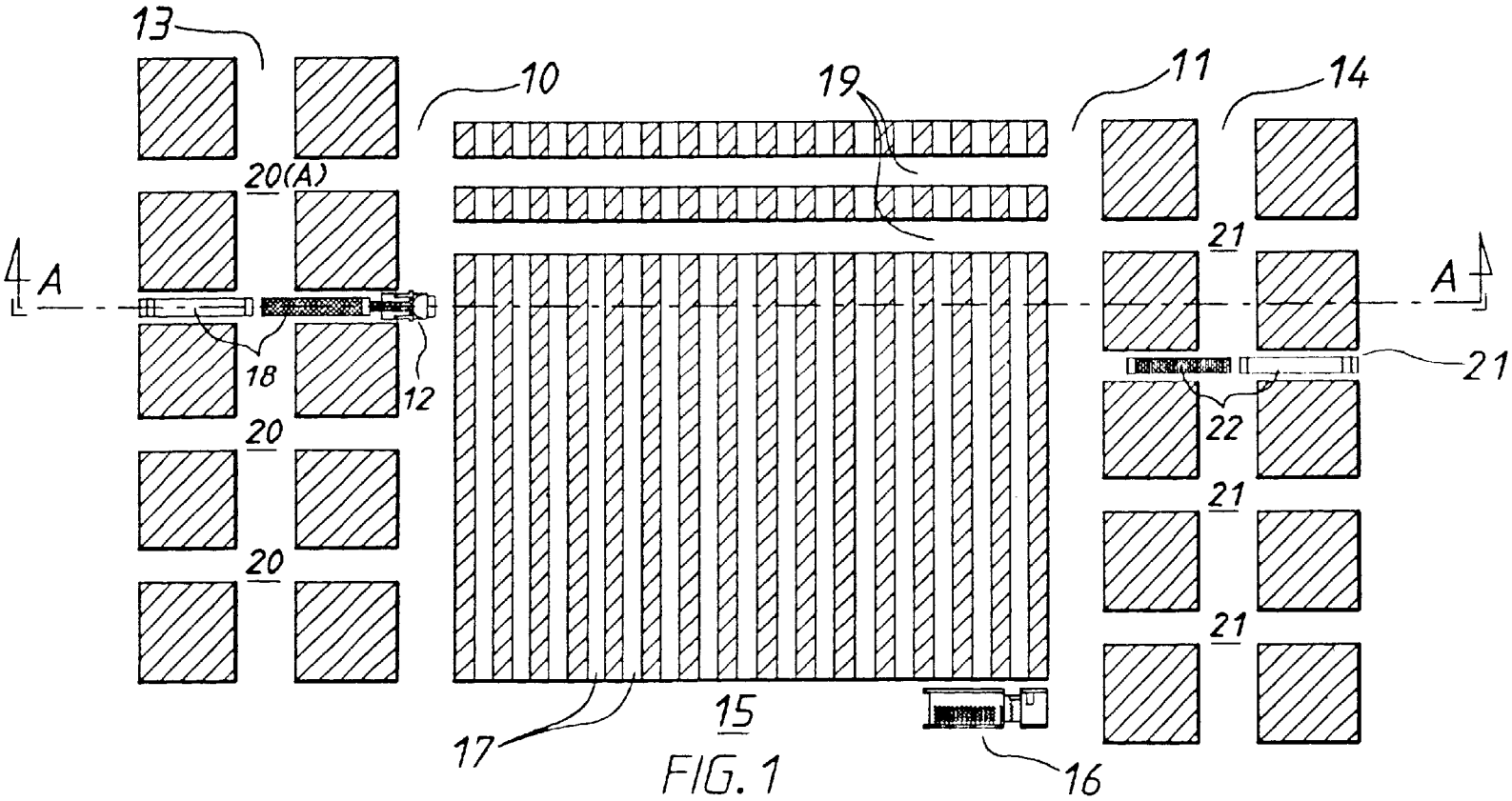
FIG. 1 is a schematic plan view of a mine.
Figure 4:
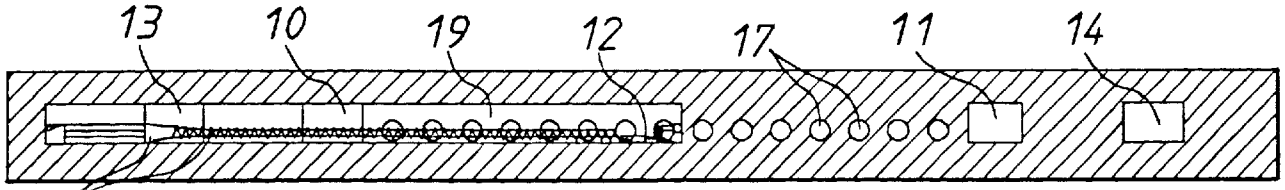
FIG. 4 is a schematic side elevation of the mine as illustrated in FIG. 3 sectioned along the line 4—4 of FIG. 3.
Figure 3:
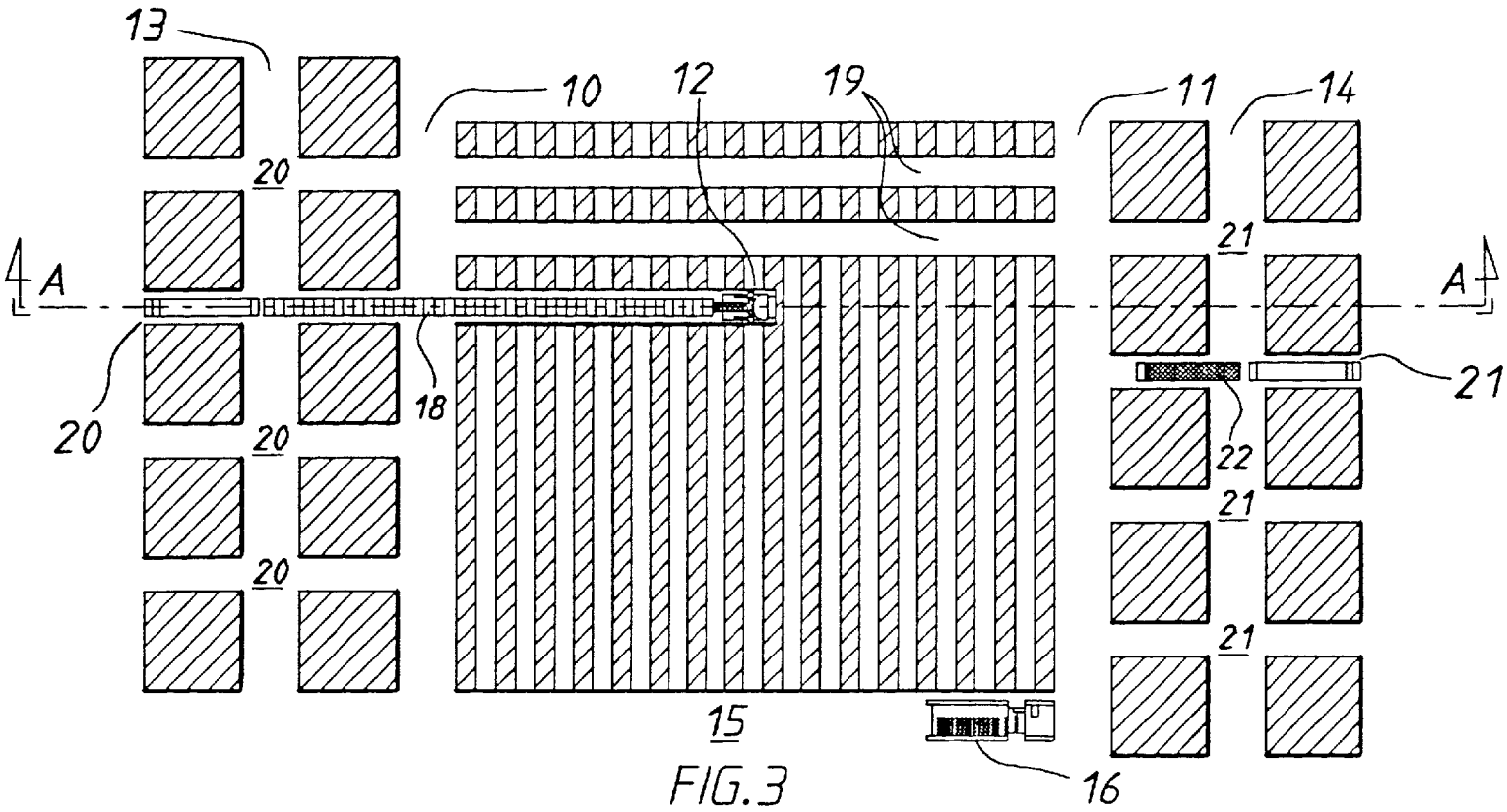
FIG. 3 is a schematic top plan view of a further development of the mine of FIG. 1.
Figure 6:
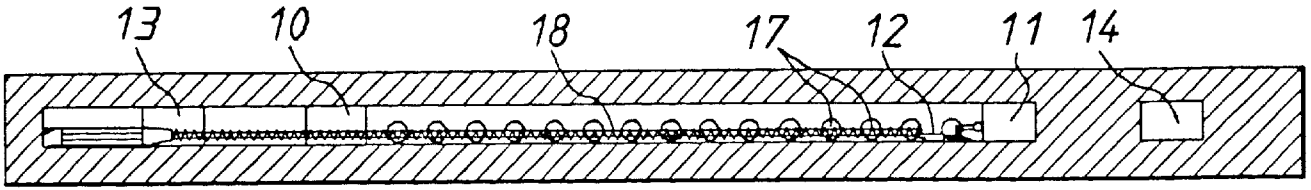
FIG. 6 is a schematic side elevation of the mine as illustrated in FIG. 5 sectioned along the line 6—6 of FIG. 5.
Figure 5:
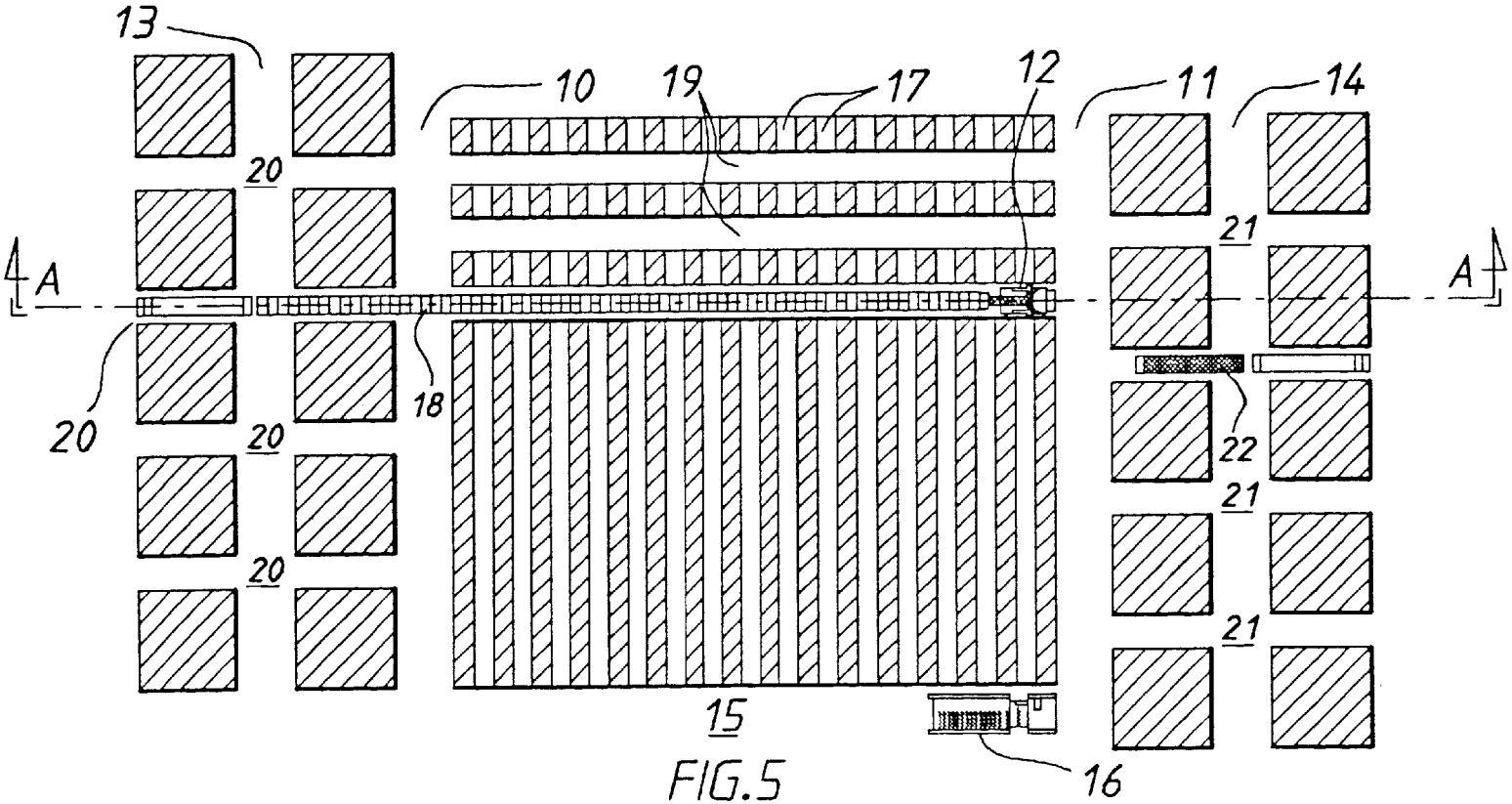
FIG. 5 is a schematic top plan view of a further development of the mine as illustrated in FIG. 3.
Figure 8:
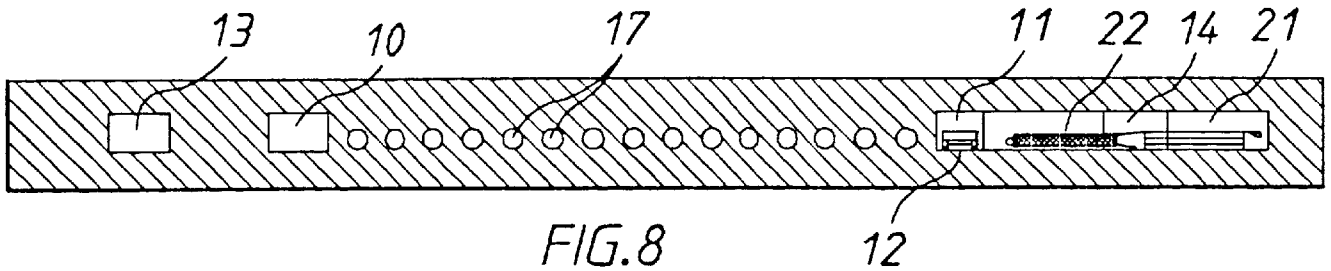
FIG. 8 is a schematic side elevation of the mine as illustrated in FIG. 7 sectioned along the line 8—8.
Figure 7:
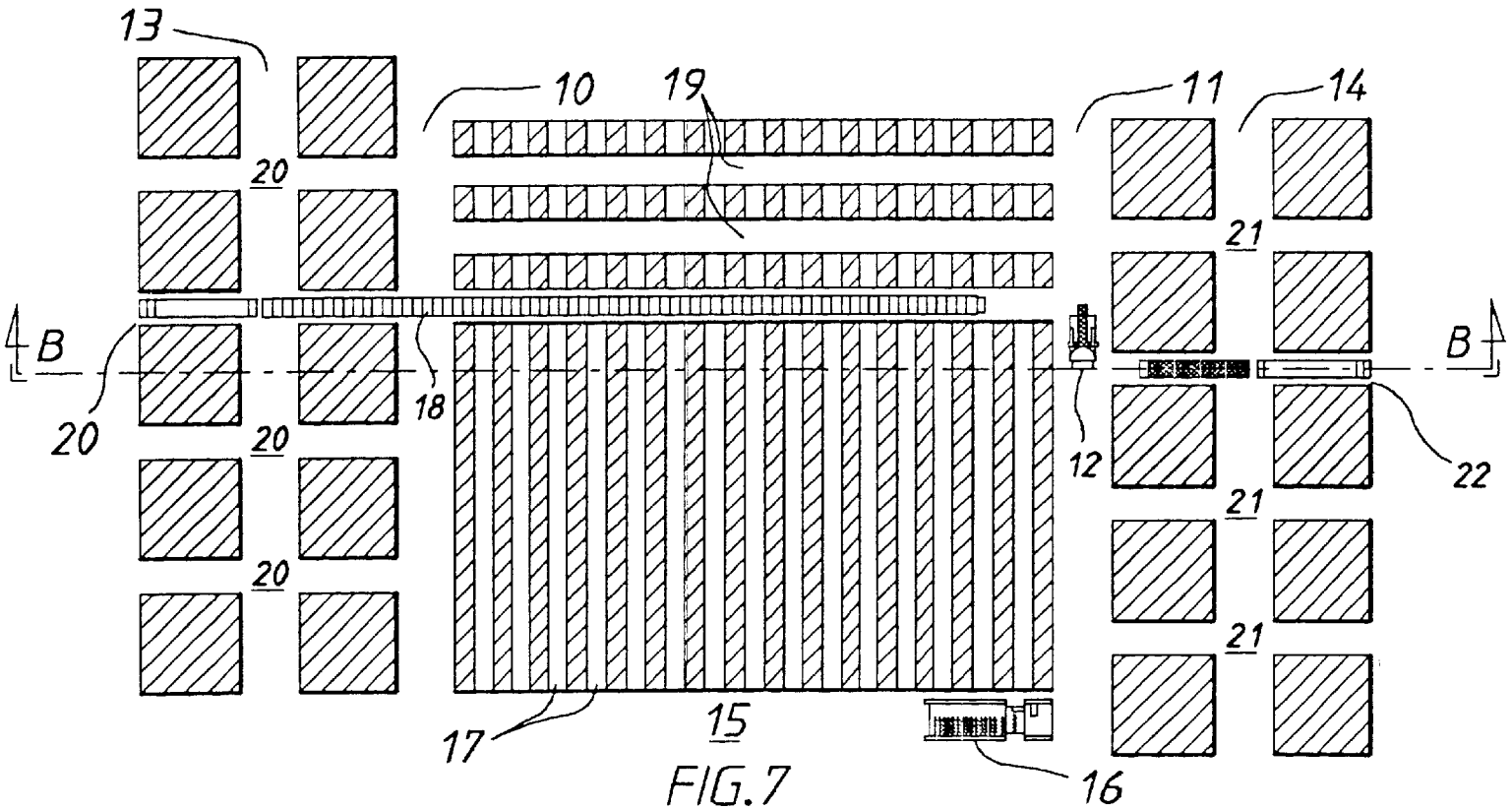
FIG. 7 is a schematic top plan view.
Figure 10:
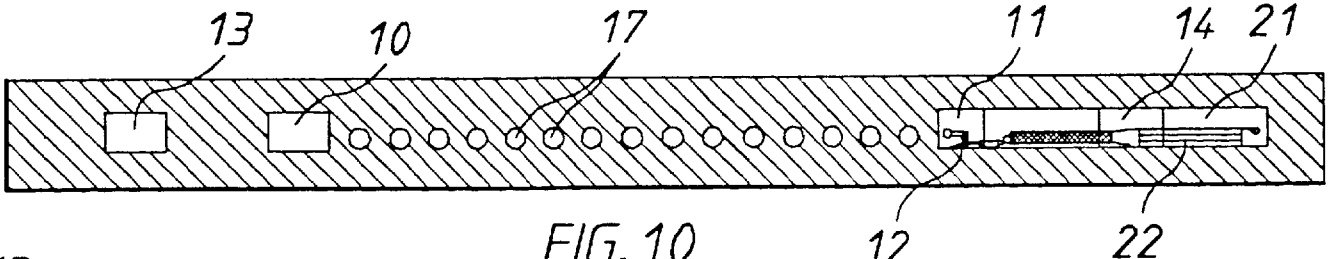
FIG. 10 is a schematic side elevation of the mine as illustrated in FIG. 9, sectioned along the line 10—10 of FIG. 9.
Figure 9:
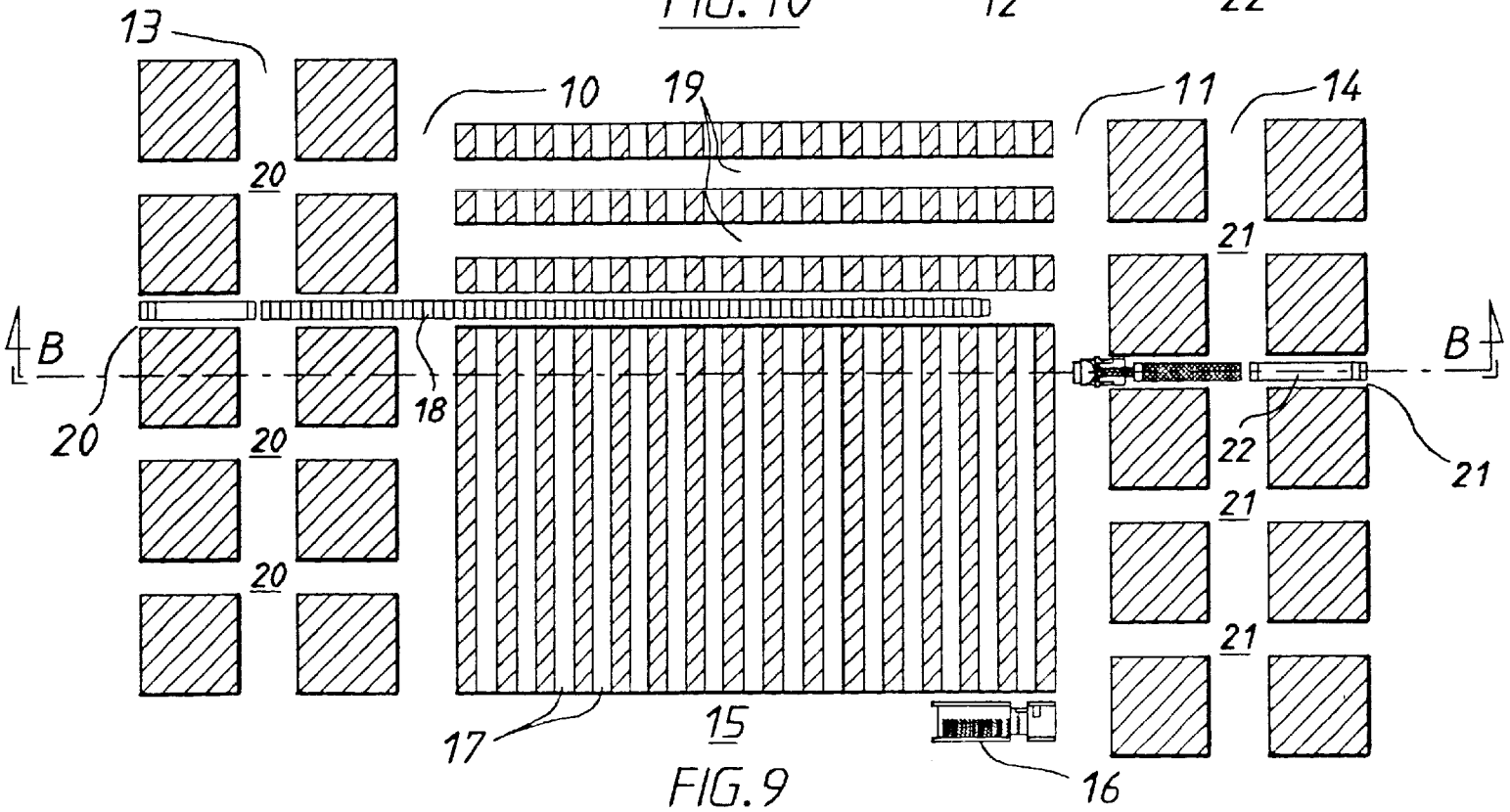
FIG. 9 is a schematic top plan view of a development of the mine as illustrated in FIG. 7.

In addition to the above mentioned roads, 10, 11, 13–15 and 17, there is formed transverse roads 20 and 21. The roads 20 extend from the road 10 and intersect with the road 13. The roads 21 extend from the road 11 and intersect with the road 14. It should be noted that the roads 20 are located at equally spaced positions along the roads 10 and 13, while the roads 21 are located at equally spaced distance along the roads 11 and 14. The roads 20 are not aligned with the roads 21, that is the roads 21 are displaced relative to the roads 20 by approximately half the distance between the roads 20. It should further be appreciated that the roads 20 are spaced by the same distance as the roads 21. When the roads 10, 11, 13–15, 20 and 21 have been formed, further transverse roads 19 are formed extending between the roads 10 and 11. The roads 19 are parallel and coextensive and aligned either with roads 20 or 21. The machine 12 and its associated conveyor 18 are initially located in the road 20(A). Thereafter the machine 20 progresses from the road 10 to the road 11 removing coal and delivering the coal to the conveyor 18. As the machine 20 progresses the conveyor 18 elongates and transports coal to either shuttle cars or conveyors located rearwardly of the conveyor 18. While the continuous miner progresses in mining roads 19 a fan forces fresh ventilation air (see FIG. 1 and FIG. 9) to a position immediately behind the continuous miner via the auger holes 17. When the machine 12 reaches the road 11, the conveyor 18 is disconnected and the machine 12 maneuvered to engage a second conveyor 22. Thereafter the machine 12 forms a further transverse road 19 extending from the road 11 to the road 10. During this latter step, the conveyor 18 is contracted and moves to the next adjacent road 20. When the machine 12 reaches the road 10, it is disconnected from the conveyor 22 and re-attached to the now re-located conveyor 18. Thereafter the machine 12 forms a further transverse road 19 while the conveyor 22 is contracted and moves to the next adjacent road 21. This sequence is repeated as best seen in FIGS. 1, 3, 5, 7 and 9 until a final transverse road 19 is formed adjacent the road 15. Mined material conveyed by the conveyor 22 is also delivered to a conveyor or shuttle cars located towards the rear of the conveyor 22.

The above described preferred embodiment has the advantage of employing a single mining machine 12 in association with a pair of conveyors 18 and 19, and an auger mining machine 16. A particular advantage of this method of mining is that there is a large number of escape of routes provided. A further advantage is provided in that no longwall mining machine need be used.

A further advantage is that the continuous conveyance of coal from the continuous miner, allows the miner for a greater number of hours per day which results in high production.

Furthermore the auger holes (usually) require no artificial roof support and consequently the cost of this continuous miner/auger mining method is less expensive than bord and pillar.

The capital employed is lower than longwall mining, while producing at similar rates.

A further advantage is the dual use of auger holes which permit both the production of coal and subsequent use as a conduit to deliver ventilation air to the continuous miner.

What is claimed is:

1. A method of mining including the steps of:

(a) forming a pair of longitudinal generally parallel roads in a seam to be mined, the roads being transversely spaced;

(b) forming a transverse road between the pair of roads;

(c) forming a plurality of further longitudinal roads from the transverse road, the further longitudinal roads being located at spaced locations between said pair of longitudinal roads;

(d) forming a plurality of further transverse roads so that the further transverse roads and the further longitudinal roads intersect; and wherein (e) the further transverse roads are formed by a continuous miner that reciprocates between said pair of longitudinal roads and co-operates with a pair of extendable conveyors, conveyors being located on said further longitudinal roads to convey the mined material from the continuous miner, with the conveyors being located sequentially at longitudinally spaced locations along said pair of longitudinal roads as the further transverse roads are formed.

2. The method of claim 1 wherein the further longitudinal roads are formed by an auger mining machine.

3. The method of claim 2 wherein there is associated with each pair of longitudinal roads a further longitudinal road, with said further transverse roads being arranged such that every second of said further transverse roads extends between a first one of said pair of longitudinal roads and its associated further longitudinal road, with the transverse roads other than said every second transverse road extending between a second one of said longitudinal roads and its associated further longitudinal road.

4. The method of claim 3 wherein the transverse roads passing through the first one of said pair of longitudinal roads and its associated further longitudinal road are spaced by a predetermined distance, the further roads passing through the second one of said pair of longitudinal roads and its further longitudinal road are also spaced by said predetermined distance, with adjacent transverse roads being spaced by approximately half said predetermined distance.

* * * * *